US006247954B1

(12) United States Patent
Ju

(10) Patent No.: US 6,247,954 B1
(45) Date of Patent: Jun. 19, 2001

(54) ZERO INSERTION FORCE ELECTRIC CONNECTOR

(76) Inventor: Ted Ju, No. 15, Wu Shiunn St., An Leh District, Keelung City (TW)

( * ) Notice: Subject to any disclaimer, the term of this patent is extended or adjusted under 35 U.S.C. 154(b) by 0 days.

(21) Appl. No.: 09/619,677

(22) Filed: Jul. 19, 2000

(51) Int. Cl.[7] ..... H01R 4/50; H01R 13/625
(52) U.S. Cl. ..... 439/342
(58) Field of Search ..... 439/342, 747, 439/259

(56) References Cited

U.S. PATENT DOCUMENTS 5,529,511 * 6/1996 Matsuoka ..... 439/342

* cited by examiner

*Primary Examiner*—Tulsidas Patel
*Assistant Examiner*—Javaid Nasri
(74) *Attorney, Agent, or Firm*—Bacon & Thomas, PLLC

(57) ABSTRACT

A zero insertion force electric connector is proposed, which especially has a design to the terminals of the connector. The terminal includes a head and a leg post. The two clamping pieces of the head have front surfaces having an approximate U shape. An upper inclined elastic piece is installed at the center of the two clamping pieces. Two upper halves of the two clamping pieces are made closer to be formed as a slit. The upper end of the slit is formed with an inclined opening. Therefore, the two clamping pieces are formed as a three cambered structure. By the apexes of this cambered structure, the head has an upper fulcrum, a middle fulcrum, and a lower fulcrum. Thereby, the terminal inserted into the base of the electric connector prevents the terminals to be released from the upper side. Moreover, the pits at two sides of the bottom of the slot in the base serve to support the head to prevent from releasing and have the functions of preventing the welding agent to flow into the inserting groove.

3 Claims, 9 Drawing Sheets

ZERO INSERTION FORCE ELECTRIC CONNECTOR

FIELD OF THE INVENTION

The present invention relates to a zero insertion force electric connector which especially has a design to the terminals of the connector in a central processing unit and the slot thereof. Thereby, terminals are inserted steadily. Moreover, the manufacturing of the terminal is suitable to be used in a brush welding. Moreover, the design of the electric base is matched to the design of the terminal for preventing the welding agent from flowing into the slits.

BACKGROUND OF THE INVENTION

The zero insertion force electric connector of a central processing unit is formed by a base, a driving rod and a movable plate. The top of the slot is formed with a power supply inserting holes for being inserted by terminals and matched with the pins of the central processing unit. The driving rod is formed at the rear side of the top of the base and it is covered and positioned by the movable plate. By upward and downward movement of the driving rod, the movable plate may move forwards and backwards. The slots on the surface of the movable plate are correspondent to the inserting holes on the surface of the base. If the driving rod is moved upwards, the slots on the movable plate are alternatively arranged with the inserting holes on the base. If the driving rod is moved downwards, they are aligned. Therefore, the plurality of pins of the central processing unit are inserted into the slots on the surface of the movable plate, respectively. When the slot is moved downwards and is resisted to be positioned, the movable plate will move to a predetermined position so that the pins of the central processing unit are clamped in the terminals within the slots. On the contrary, the pins of the central processing unit will separate from the terminals in the slots.

The prior art terminal has only one inclined protruded elastic contact with a small contact area with the pins of the central processing unit. A single point contact structure is formed. Thus, it is not suitable to be used in current high frequency central processing unit.

In general, as a prior art terminal is inserted into a slot of a base, a gap is formed therebetween so that the terminal is easy to vibrate. Therefore, as the leg post of the terminal is welded in a circuit board, the welding agent is easy to flow into the gap. This has a bad effect to the quality of a zero insertion force electric connector. Therefore, the present invention provides a zero insertion force electric connector, in which two clamping pieces are formed as a cambered structure with three cambered portions. The apexes of cambered portions are installed with a three-fulcrum structure of an upper fulcrum, a middle fulcrum and a lower fulcrum so as to be steadily and effective supported in the slots of the base. Moreover, by two pits on the bottom of the slot, the welding agent is prevented from flowing into the gap between the terminal and slot.

SUMMARY OF THE INVENTION

Accordingly, the primary object of the present invention is to provide a zero insertion force electric connector which especially has a design to the terminals of the connector in a central processing unit. Thereby, the terminal inserted into the base of the electric connector inserted prevents the terminals to be released from the upper side. This terminals are suitable to be used in a high frequency central processing unit. Moreover, the manufacturing of the terminal is suitable to be used in a brush welding.

Another object of the present invention is to provide a zero insertion force electric connector, wherein the design of the electric base is matched to the design of the terminal for preventing the welding agent from flowing into the slits.

The various objects and advantages of the present invention will be more readily understood from the following detailed description when reading in conjunction with the appended drawing.

DETAILED DESCRIPTION OF THE PREFERRED EMBODIMENTS

Figure 1:
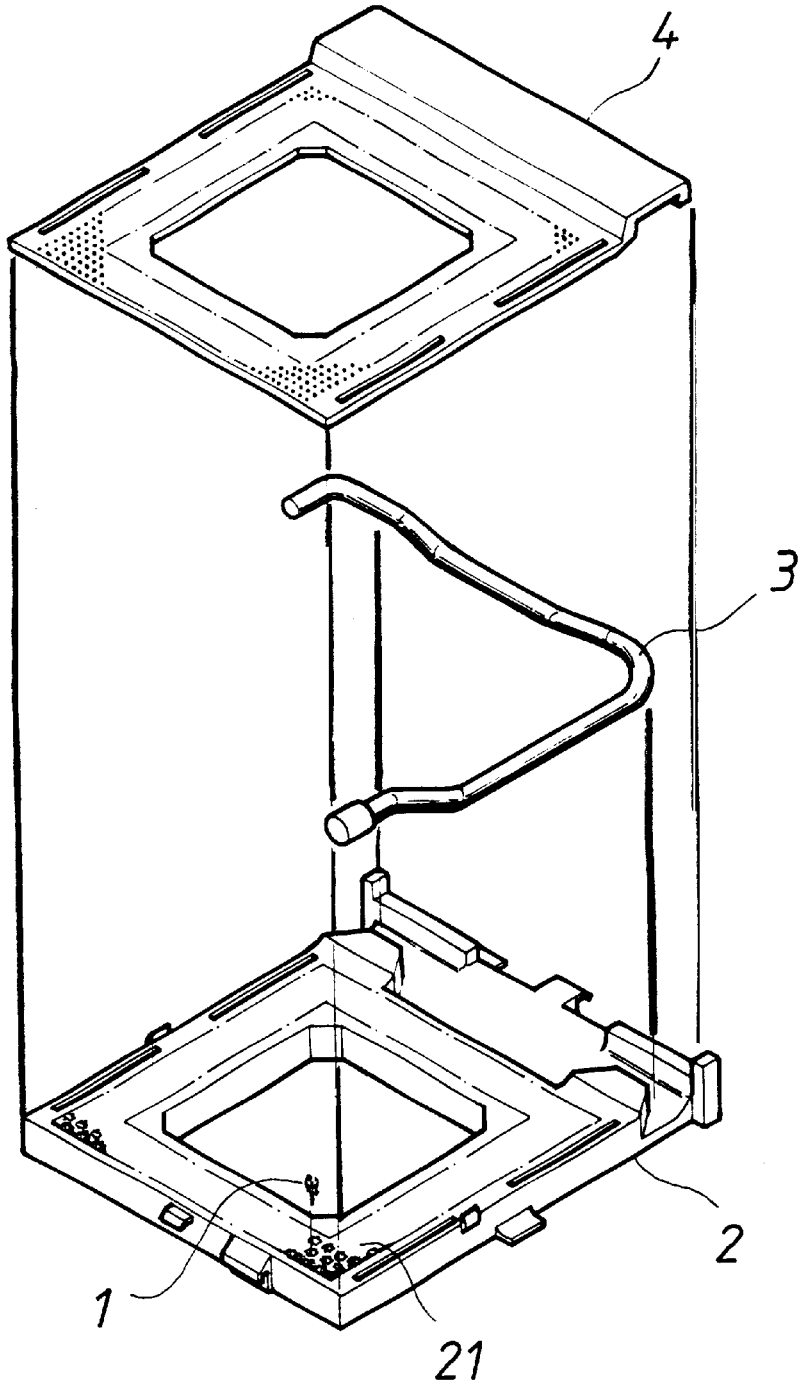
FIG. 1 is an exploded perspective view of the electric connector of the present invention.
Figure 2:
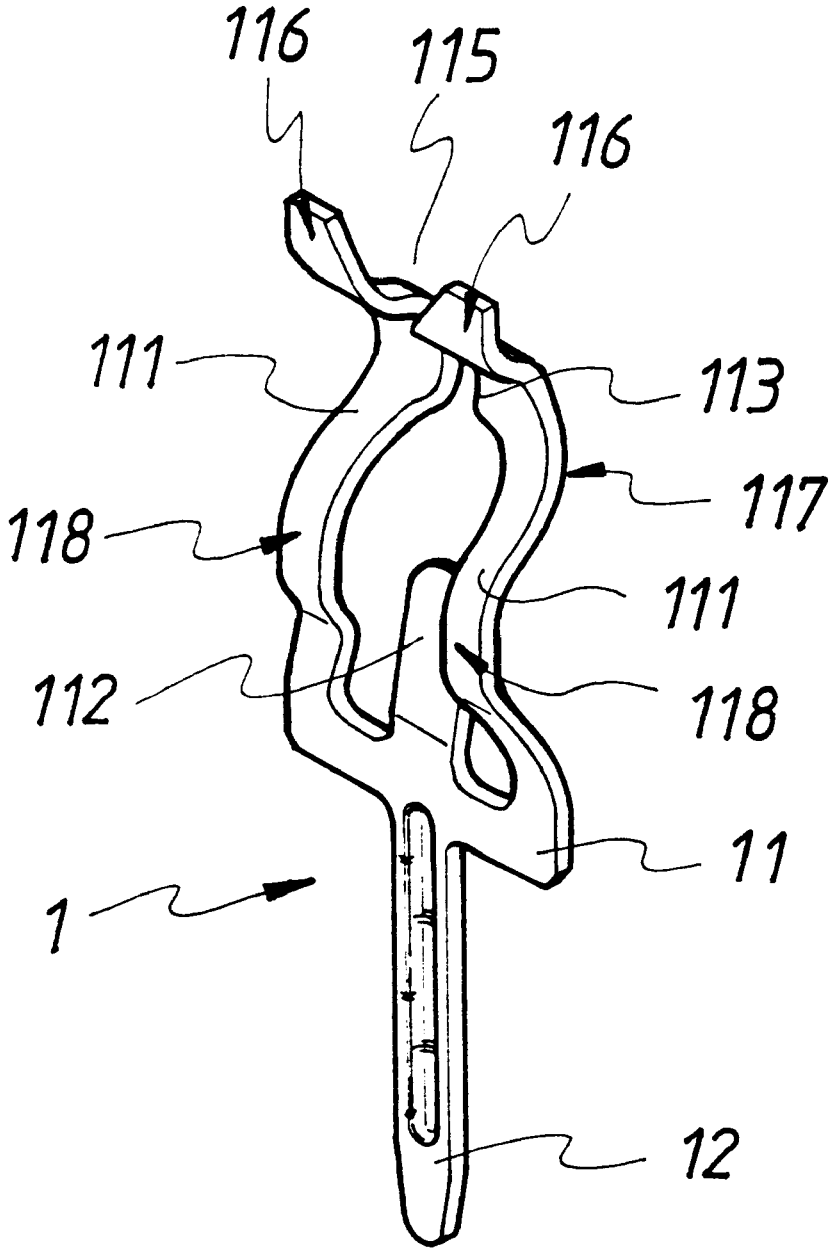
FIG. 2 is a perspective view of the terminal structure of the present invention.

With reference to FIG. 1, the zero insertion force electric connector of the present invention is illustrated. The electric connector is formed by a plurality of terminals 1, a base 2, a driving rod 3 and a movable plate 4. The base 2, driving rod 3, and movable plate 4 have shapes and structures as those shown in prior arts, and not the primary concern of the present invention. In the present invention, the terminals 1 and slot 21 of the base 2 are main concerns.

Figure 3:
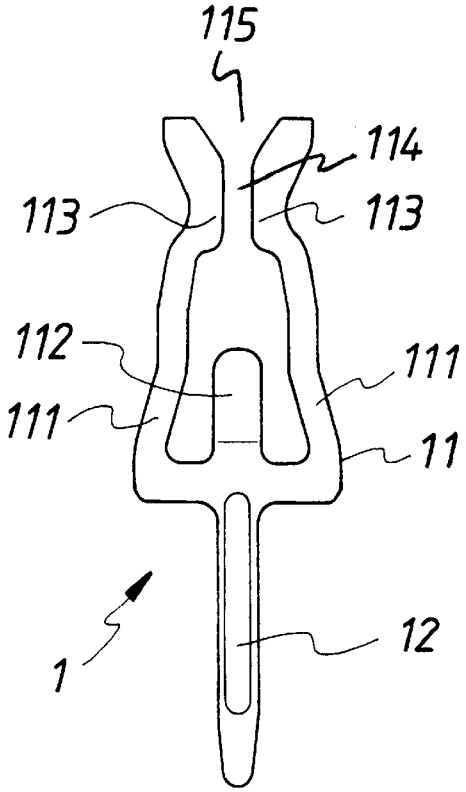
FIG. 3 is a front view of the terminal structure of the present invention.
Figure 4:
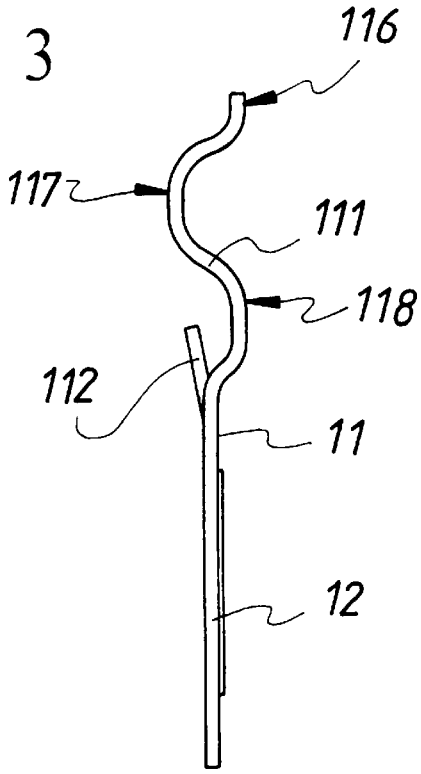
FIG. 4 is a lateral view of the terminal structure of the present invention.

Each terminal 1 (as shown in FIGS. 3 and 4) is punched and bent by a metal piece. The terminal includes a head 11 at the upper portion thereof and a leg post 12 at the lower portion thereof. The head 11 has two upright clamping pieces 111. The head has a U shape front face, and an upward inclined elastic buckles 112 are installed at the center of each clamping piece 111. A protrusion 113 is formed at the inner side of the upper section of each clamping piece 111 at a selective position. Thus, a slit 114 is formed between the two protrusions, and an inclined opening 115 is formed at the upper end of the slit 114. The two clamping pieces are formed as an elastic cambered structure bending in the front and rear direction. The apexes of the bending are formed as an upper fulcrum 116, a middle fulcrum 117 and a lower fulcrum 118.

Figure 5:
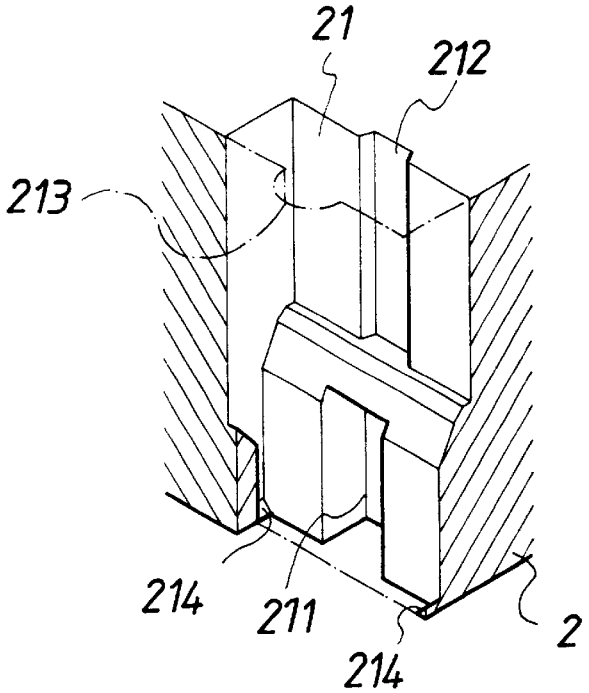
FIG. 5 is a schematic perspective view of one lateral structure of the slot according to the present invention.
Figure 6:
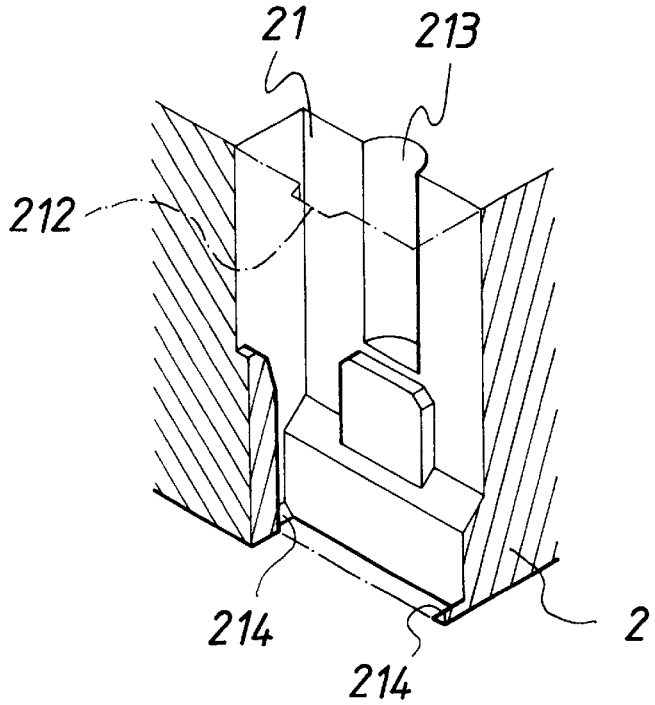
FIG. 6 is a schematic perspective view of another lateral wall of the slot in the present invention.

The base 2 (as shown in FIGS. 1, 5 and 6) is a rectangular frame. The surface of the base is formed with a plurality of penetrating stepped rectangular slots 21. A lateral wall at each slot 21 has a buckling groove 211 at the center of the lower section thereof. A vertical receiving groove 212 is formed at the center of an upper lateral wall of a selective slot 21. Further, a semicircle inserting hole is 213 formed at another lateral wall of the selective groove, which extends to the top of base 2. The bottom of the slot 21 has two sides each of which is formed with a pit 214.

Thereby, each terminal 1 can be inserted to the slot 21 from the upper side of the base 2 and the leg post 12 at the bottom of the head 11 extends to be below the base 2. The lower edge of the head 11 is exactly placed between two pits 214 of the slot 21. A supporting and sealing structure is formed by the two pits 214 so that as the present invention and the circuit board are combined so as to pass a tin furnace for being welded, the pits 214 has the function of preventing the welding agent from flowing into the slit. The center elastic piece 112 of the terminal 1 is exactly used to resist against the upper end of the buckling groove 211. Thereby, the terminal 1 is prevented from releasing. However, the feature of the present invention is that the head 11 is bent to be formed as an upper fulcrum 116, middle fulcrum 117 and lower fulcrum 118. Therefore, it can resist against the two lateral walls of the slot 21, especially, the middle fulcrum 117 resists against the lateral wall of the receiving groove 212. By elastically resisting, the terminal 1 is hard to vibrate or swing. Thereby, the terminal of the present invention can be steadily inserted.

Figure 7:
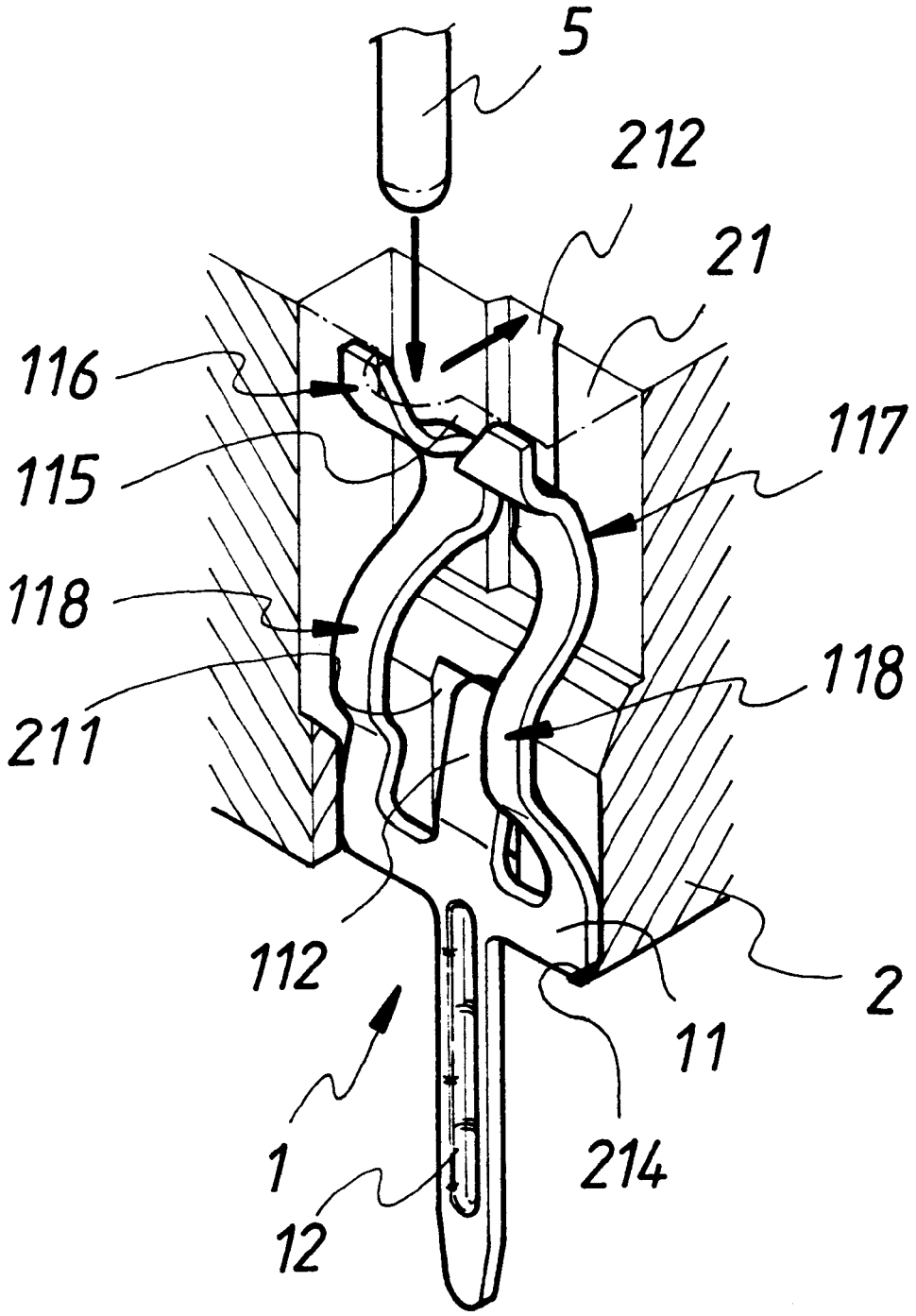
FIG. 7 is a schematic perspective view showing the action of inserting pins in the present invention.
Figure 8:
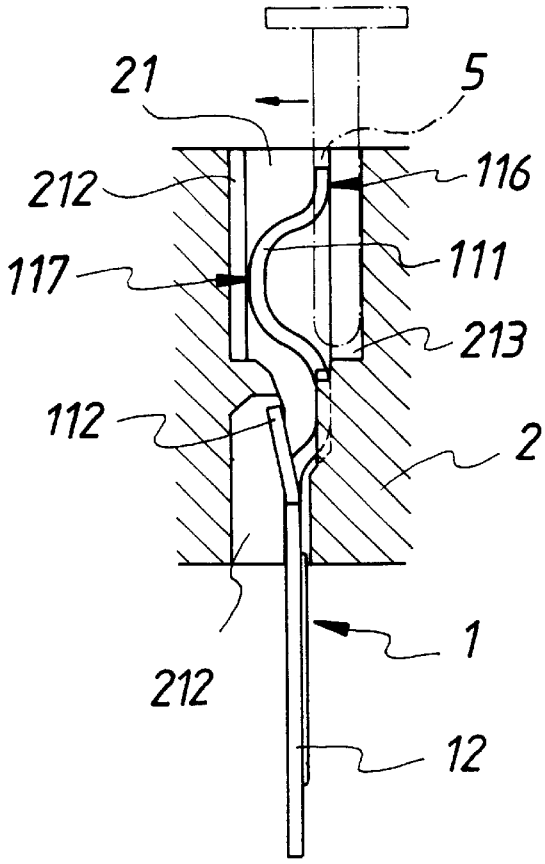
FIG. 8 is a lateral view showing the action of inserting pins in the present invention.
Figure 9:
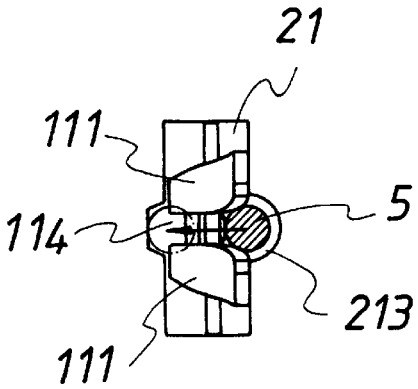
FIG. 9 is a cross sectional view showing the insertion of pins in the present invention.
Figure 10:
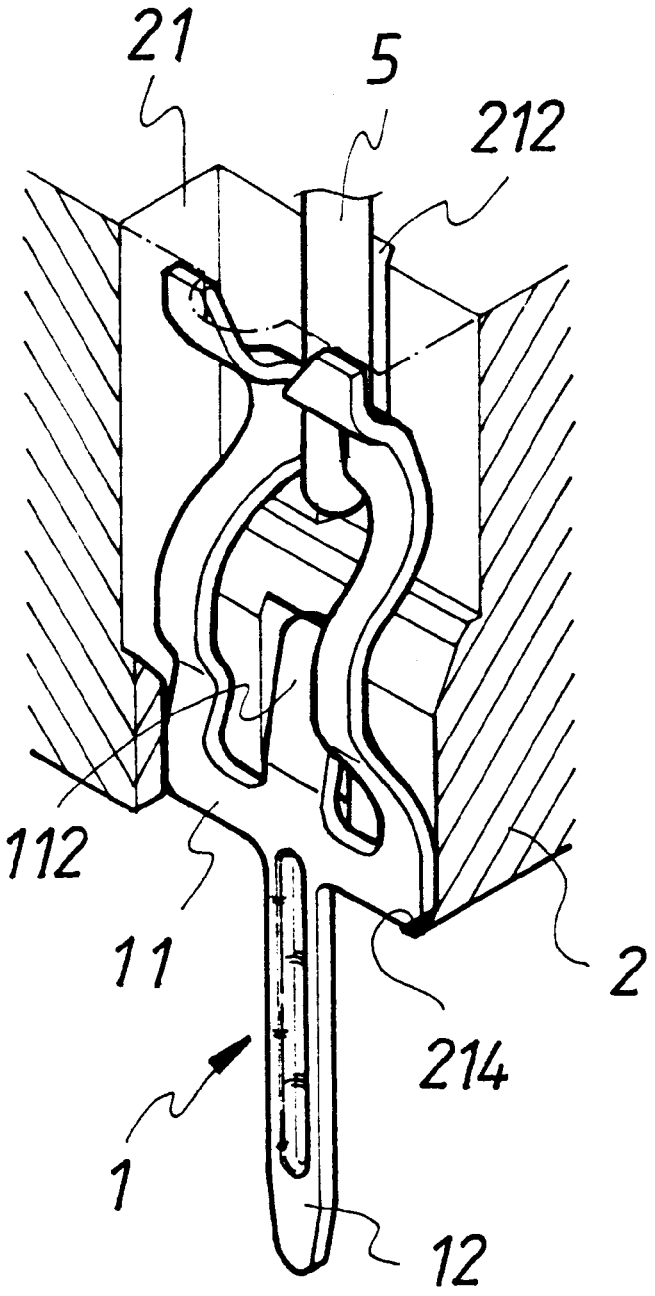
FIG. 10 is a schematic perspective view of clamping of the pins in the present invention.
Figure 11:
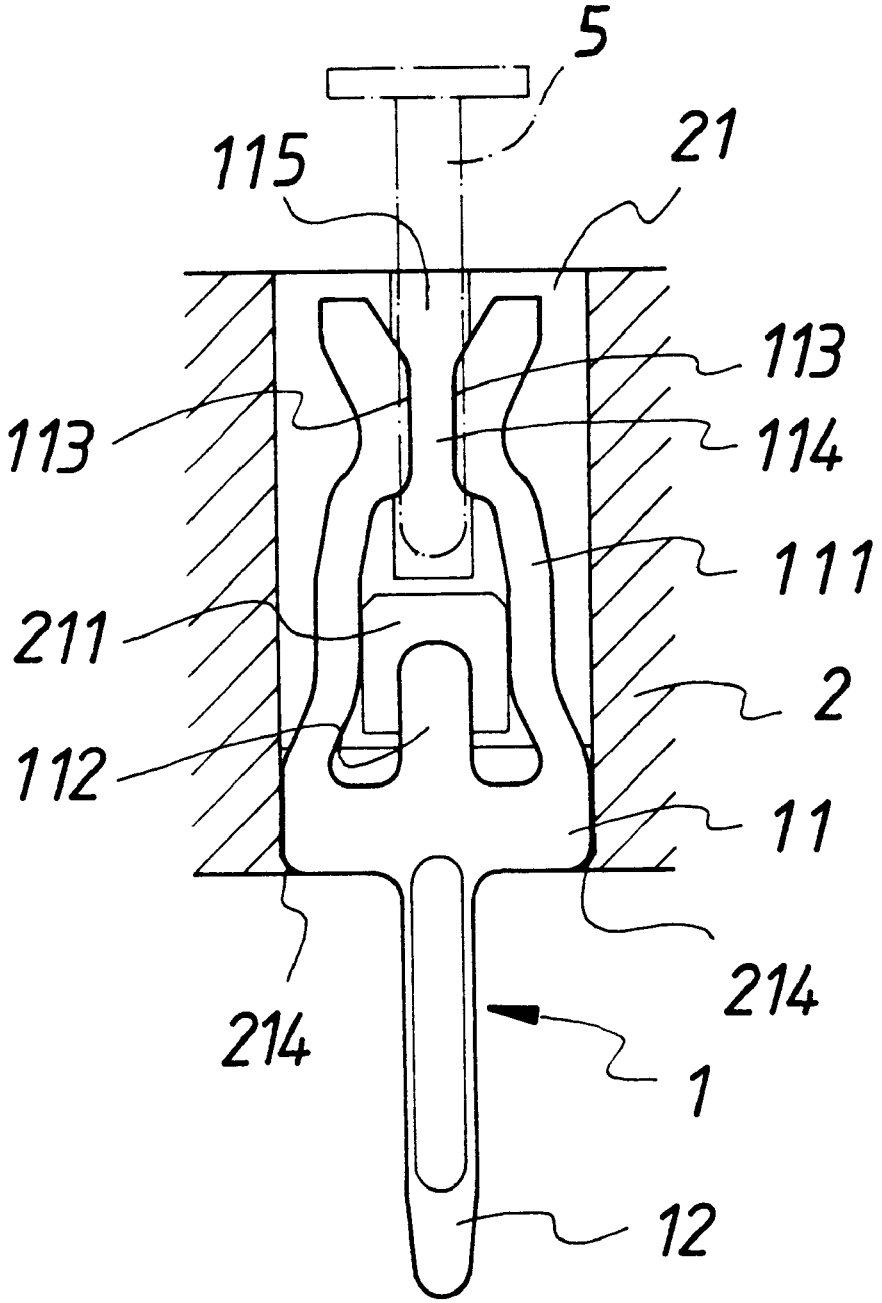
FIG. 11 is a front schematic view showing clamping of the pins in the present invention.

By the electric connector of the present invention, in using, the pins 5 of the central processing unit is inserted into the semi-round inserting hole 213 (as shown in FIG. 7). Then the prior art driving rod 3 is moved so that the movable plate 4 pushes each pin 5. By the inclined opening 115 of the head 11 the pins 5 are easily engaged (as shown in FIGS. 8 and 9), and pins 5 are clamped in the receiving groove 212 of the slot 21. The two protrusions 113 of the head 11 are electrically connected to the pins 5 (as shown in FIGS. 10 and 11) at two points, thereby, the present invention can be used in a high frequency central processing unit. Furthermore, since the present invention has three fulcrums, as a general central processing unit is detached, the structure of the terminal can be retained and the position is fixed.

Moreover, in general, the terminals are necessary to be plated in contact points. In the prior art, the contact point of the terminal is an inclined piece, thus it is performed by a complete sink plating so that the cost is high. While in the present invention, the head 11 of the terminal 1 has three elastic bending portions and the flat protrusion 113 at the middle fulcrum 117 is electrically conducted to the pins 5, thereby, by the cambered middle fulcrum 117, an cheap brush plating can be used to reduce cost.

Figure 13:
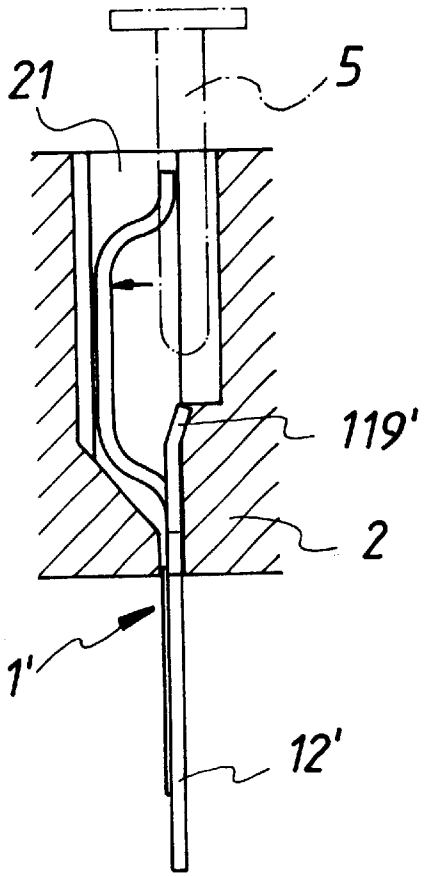
FIG. 13 is a schematic view showing the use of another embodiment in the present invention.
Figure 12:
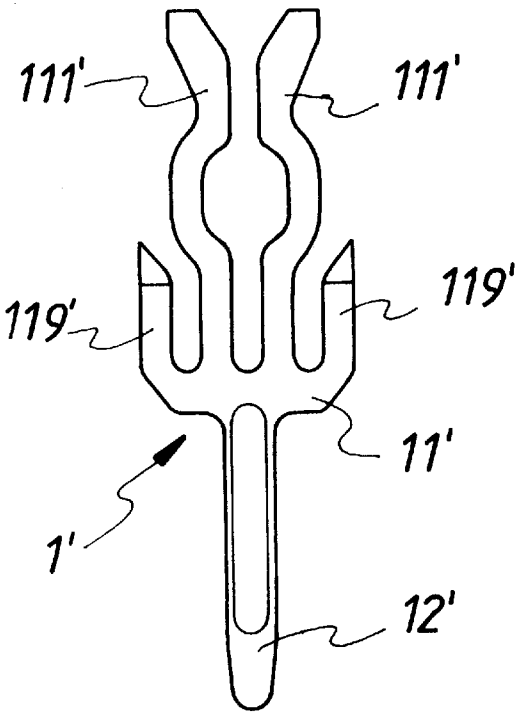
FIG. 12 is a front schematic view of another embodiment in the present invention.

Moreover, as shown in FIGS. 12 and 13, the terminal 1' of the present invention may be modified slightly. Two sides at the bottom of the head 11' are extended with respective retainers 119' which extend upwards and have tip ends. Therefore, when the terminal 1' is inserted into the slot 21 of the base 1, the tips of the retainers 119' will pierce into one lateral wall of the slot 21 so as to achieve the object of preventing the terminal 1 from dropping off.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A zero insertion force electric connector comprising a plurality of terminals, a base, a driving rod and a movable plate, each terminal is punched and bent by a metal piece and including a head at an upper portion thereof and a leg post at a lower portion thereof; the head has two upright clamping pieces; an upward inclined elastic buckle is installed between said clamping pieces; a protrusion is formed at an inner side of an upper section of each clamping piece at a selective position; a slit is formed at a center of the head, and an inclined opening is formed at an upper end of the slit; the two clamping pieces are formed as an elastic cambered structure bending in a front direction and a rear direction; the apexes of the bending are formed as a three fulcrum structure including an upper fulcrum, a middle fulcrum and a lower fulcrum; the base has a surface being formed with a plurality of penetrating stepped rectangular slots; a selected lateral wall at each slot has a buckling groove at the center of a lower section thereof; a vertical receiving groove is formed at a center of an upper lateral wall of a selective slot; an inserting hole is formed at another lateral wall of a selective groove, which inserting hole extends to the top of the base; whereby, each terminal is inserted into the slot from an upper side of the base so that the elastic buckle resists against an upper end of the buckling groove at one lateral wall to prevent its release; while the three fulcrum structure, including said upper fulcrum, said middle fulcrum and said lower fulcrum, elastically resist against a pair of lateral walls of the slot to retain therein steadily.

2. The zero insertion force electric connector as claimed in claim 1, wherein two sides at a bottom of the head are extended with respective retainers which extend upwards and have tip ends; whereby, when the terminal is inserted into the slot, the tips of the retainers will pierce into one lateral wall of the slot, thereby preventing the terminal from dropping off.

3. The zero insertion force electric connector as claimed in claim 1 or 2, wherein each of two lateral sides of a bottom of the slot has one respective pit so that as each terminal is inserted into the slot, the lower edge of the head is exactly placed between the two pits of the slot to form a supporting and sealing structure.

* * * * *